US011394137B2

(12) United States Patent
Stolan

(10) Patent No.: US 11,394,137 B2
(45) Date of Patent: Jul. 19, 2022

(54) DEVICE FOR INTERCONNECTING CABLES

(71) Applicant: NEXANS, Courbevoie (FR)

(72) Inventor: Ronny Stolan, Gamle Fredrikstad (NO)

(73) Assignee: NEXANS, Courbevoie (FR)

( * ) Notice: Subject to any disclaimer, the term of this patent is extended or adjusted under 35 U.S.C. 154(b) by 0 days.

(21) Appl. No.: 16/992,803

(22) Filed: Aug. 13, 2020

(65) Prior Publication Data

US 2022/0094084 A1 Mar. 24, 2022

(30) Foreign Application Priority Data

Aug. 27, 2019 (EP) ..... 19306035

(51) Int. Cl.
*H01R 9/05* (2006.01)
*H01R 4/50* (2006.01)

(52) U.S. Cl.
CPC ..... *H01R 9/0503* (2013.01); *H01R 4/5016* (2013.01)

(58) Field of Classification Search
CPC .. H01R 4/5025; H01R 4/5033; H01R 4/5083; H01R 11/09
See application file for complete search history.

(56) References Cited

U.S. PATENT DOCUMENTS 2,339,488 A * 1/1944 Kratoville ..... H01R 4/5025 403/305
4,912,815 A * 4/1990 Jenkins ..... G02B 6/4428 24/122.3
2004/0192121 A1 9/2004 Tomasino

FOREIGN PATENT DOCUMENTS

GB 247 559 A 10/1926
GB 2281318 * 1/1995 ..... F16G 11/05

OTHER PUBLICATIONS

EU Search Report dated Jan. 27, 2020.

* cited by examiner

*Primary Examiner* — Ross N Gushi
(74) *Attorney, Agent, or Firm* — Sofer & Haroun, LLP

(57) ABSTRACT

A device is provided for interconnecting cables having a core strand and at least one layer of strands coaxially surrounding the core strand comprises a central tightening member; first and second cylindrical segments having an opening for insertion of an end of a cable and being tightenably connected to the tightening member. An inner conical member is arranged within each cylindrical segment, having a central bore arranged for insertion of an end of the core strand and further having an outer sloping surface on which a layer of strands coaxially surrounding the core strand may be positioned. A cylindrical end piece is arranged within each cylindrical segment, having a central bore arranged for insertion of the cable and further having an inner sloping surface on which a layer of strands coaxially surrounding the core strand may be positioned.

10 Claims, 9 Drawing Sheets

DEVICE FOR INTERCONNECTING CABLES

RELATED APPLICATION

This application claims the benefit of priority from European Patent Application No. 19 306 035.7, filed on Aug. 27, 2019, the entirety of which is incorporated by reference.

FIELD OF THE INVENTION

The present invention relates to interconnecting cables, in particular a device for interconnecting cables of the type having a core strand and at least one layer of strands coaxially surrounding the core strand.

BACKGROUND

There is a general need for interconnecting, joining or splicing cables.

Cables, such as wires for bearing mechanical load or tension, often have a core strand and at least one layer of strands coaxially surrounding the core strand.

Other cables, such as electric power cables, comprise one or more conductors arranged in an insulating outer sheath. The conductors of an electrical power cable may also comprise a central conductive strand, with a plurality of layers of additional strands coaxially surrounding the central strand.

It is often necessary to interconnect two lengths of wires or power cables with a core strand and stranded, coaxially arranged conductors. In the case of offshore wires or power cables, where the cables are extremely large and heavy, and where the physical demands placed on the cable are very great, the joint between conductors must be particularly robust and must meet exacting standards of reliability.

The current method for joining together stranded conductors of two sections of offshore wires or power cables is to weld together the corresponding strands from the two cable sections, often combined with a crimp ferrule. This method has certain disadvantages. Welding is a labor-intensive and time-consuming operation requiring skilled and highly trained personnel. Welding in an offshore environment, often onboard a cable laying vessel, is particularly challenging with respect to cleanliness, stability, temperature and other environmental factors.

It is also a challenge to weld together two conductors that have a different number or configuration of strands.

Hence, there is a need for a simple device for interconnecting cables of the above-mentioned type in general, and in particular a device that meets particular requirements for use with offshore wires or power cables.

SUMMARY OF THE INVENTION

The present invention provides a device for interconnecting cables of the type having a core strand and at least one layer of strands coaxially surrounding the core strand.

BRIEF DESCRIPTION OF THE DRAWINGS

The features and advantages of the invention will be apparent from the following detailed description of exemplary embodiments, with reference to the attached drawings, wherein.

DETAILED DESCRIPTION OF THE INVENTION

Figure 1:
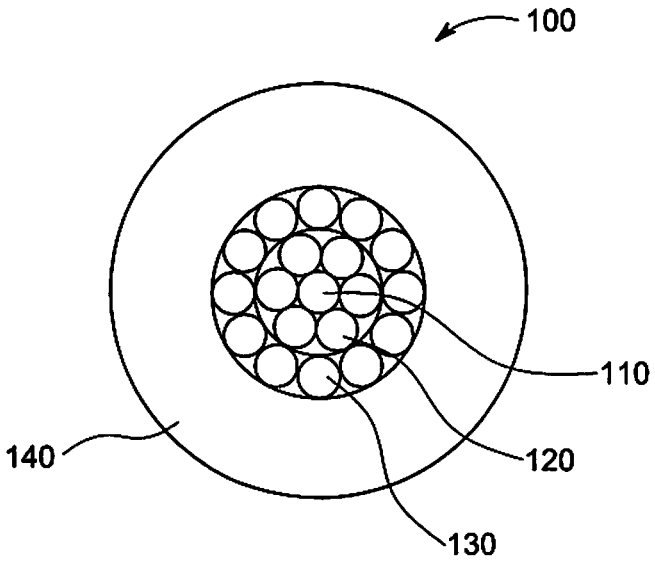
FIG. 1 is a cross sectional view of a cable for use with a device according to the invention.

FIG. 1 is a cross sectional view of a cable for use with a device according to the invention.

As illustrated in FIG. 1, the cable 100 is of the type having a core strand 110 and at least one layer of strands 120 coaxially surrounding the core strand 110. In the illustrated example, the cable has a core strand 110, a first layer of strands 120 coaxially surrounding the core strand 110, and a second layer of strands 130 coaxially surrounding the core strand 110 and the first layer of strands 120. The cable may however have only a core strand 110 and a first layer of strands 120 coaxially surrounding the core strand, or it may include any number of additional, outer layers of strands. The strands may typically be made of a metallic material, e.g. an alloy, such as steel. The strands may be made of the same material, or different strands may be made of different materials. For instance, the core strand may be made of steel while the outer layers of strands may be made of another metal or alloy.

The cable 100 may serve as a wire, with the purpose of bearing mechanical loads or tension, or it may serve as an electrical conductor, in particular for transferring electric power. An outer sheath 140 may in some cases be arranged outside the outermost layer of strands. If the cable is an electric power cable, the outer sheath 140 may typically be an insulation sheath, made of an electrically insulating material.

Figure 2:
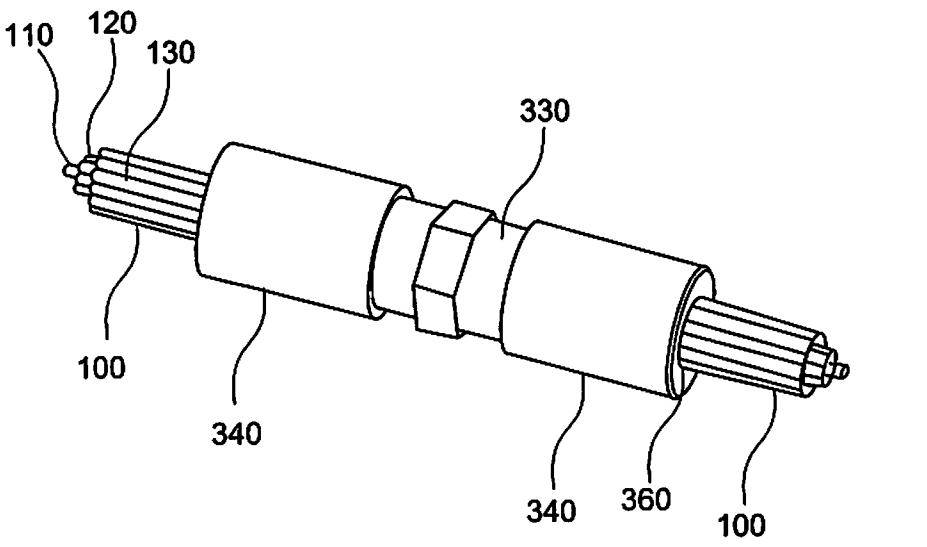
FIG. 2 is a perspective view of an embodiment of a device for interconnecting cables.

FIG. 2 is a perspective view of an embodiment of a device for interconnecting cables.

The device 200 is for interconnecting cables of the type shown in FIG. 1, i.e., cables having a core strand 110 and at least one layer of strands 120, 130 coaxially surrounding the core strand 110. The device 200 comprises a central tightening member 330 and first and second cylindrical segments 340. Each cylindrical segment 340 has an opening 360 for insertion of an end of a cable 100 at its distal end, i.e., its end facing away from the central tightening member 340. Each cylindrical segment 340 is tightenably connected to the central tightening member 330 at its central end, i.e., at its end directed towards the central tightening member 330.

Also shown in FIG. 2 are two segments of cables 100, of the type also illustrated in FIG. 1. Each cable 100 has a core strand 110 and two layers of strands 120, 130 coaxially surrounding the core strand 110.

When used with the device 200, the strands of the cables 100 are advantageously cut to same length before the strands are inserted into the device.

Figure 3:
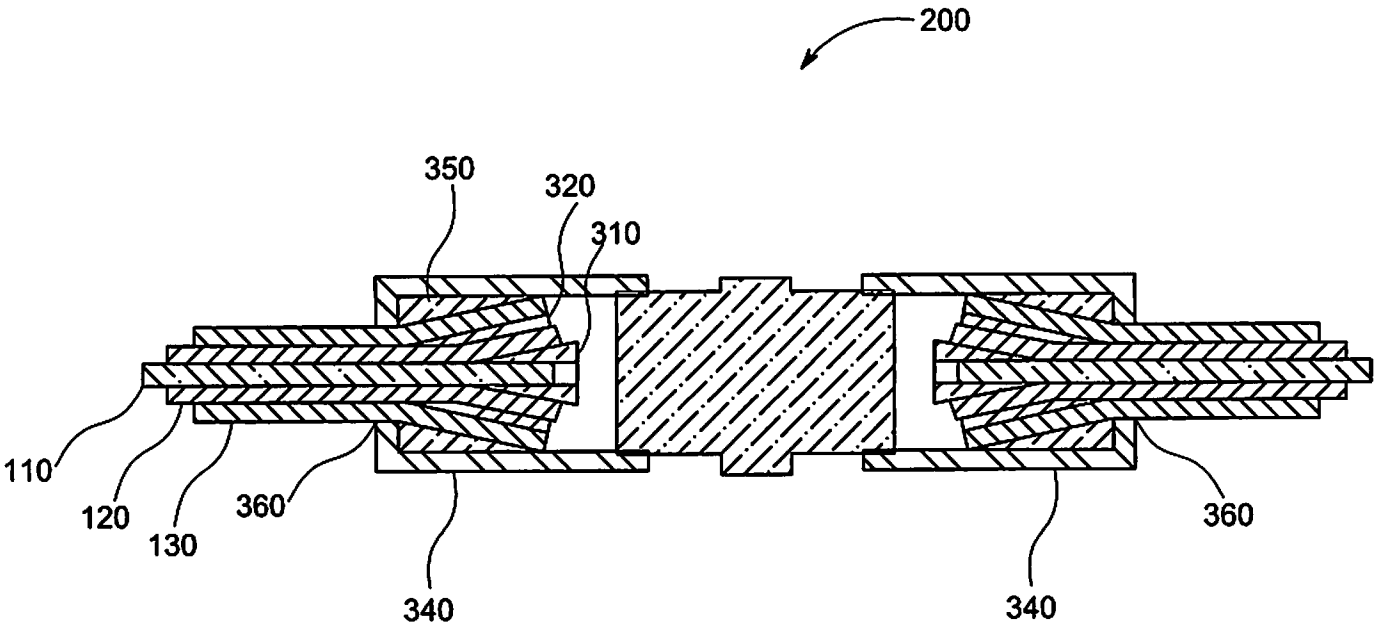
FIG. 3 is a cross sectional view of an embodiment of a device for interconnecting cables.

FIG. 3 is a cross sectional view of an embodiment of a device for interconnecting cables.

Corresponding to what is shown in FIG. 2, the device 200 is for interconnecting cables of the type having a core strand 110 and at least one layer of strands 120, 130 coaxially surrounding the core strand 110. The device 200 comprises a central tightening member 330 and first and second cylindrical segments 340. Each cylindrical segment 340 has an opening 360 for insertion of an end of a cable 100 at its distal end. Each cylindrical segment 340 is tightenably connected to the central tightening member 330 at its central end.

An inner conical member 310 is arranged within each cylindrical segment 340. The inner conical member 310 has a central bore arranged for insertion of an end of the core strand 110 of the cable 100. The inner conical member 310 further has an outer sloping surface on which the first layer of strands 120 coaxially surrounding the core strand 110 of the cable may be positioned when the device is used to interconnect the two cable segments 100.

Further, a cylindrical end piece 350 is arranged within each cylindrical segment 340. The end piece 350 is arranged within the distal end of the cylindrical segment, and may typically rest against an internal flange, ridge or rim arranged at the distal end of the cylindrical segment 340. The end piece 350 may be a separate part mounted within the cylindrical segment 340, or it may be an integrated portion of the cylindrical segment 340. In any case, the end piece 350 has a central bore arranged for insertion of the cable, corresponding to the opening 360 in the cylindrical segment 340. Further, the end piece 350 further has an inner sloping or inner conical surface. One of the layers of strands coaxially surrounding the core strand 110 of the cable may be positioned on the inner sloping surface of the end piece 350.

In the embodiment shown in FIG. 3, which is useful for cables with one central strand and two layers 120, 130 of additional, coaxial strands, the device 200 also includes an intermediate conical member 320 is arranged within each cylindrical segment 340. The intermediate conical member 320 has a central bore arranged for insertion of the core strand 110 and the first or intermediate layer of surrounding strands 120 of the cable. The intermediate conical member 320 further has an inner sloping or inner conical surface on which the intermediate layer of strands 120 that coaxially surrounds the core strand 110 of the cable is positioned during use. The intermediate conical member further has an outer sloping or conical surface on which the outermost layer of strands 130 that coaxially surrounds the core strand 110 of the cable is positioned.

If the cables used with the device 200 includes additional layers of coaxially arranged strands, the device 200 may further include additional conical members arranged within each cylindrical segment 340. In this case, each additional conical member may correspond to an additional layer of surrounding strands of the cable. The additional conical member may have the same shape and construction as the conical member 320.

Advantageously, all the conical members have essentially the same slope on their outer surfaces. Also, the conical members advantageously have rear conical openings with an inner slope arranged to accept the forward conical portion of an adjacent conical member.

The central tightening member 330 and the cylindrical segments may be axially tightened in such a way that the inner conical member 310 and the end piece 350 will be axially pressed together with the layer of strands 120 coaxially surrounding the core strand 110 sandwiched between them, resulting in a stable interconnection of the cables' ends.

In order to obtain the axial tightening, the central tightening member 330 may suitably be provided with threads, and the first and second cylindrical segments 340 are provided with corresponding threads that are mateable with the threads of the central tightening member 330. The axial tightening of the central tightening member 330 is in this case achieved by relative rotation between the central tightening member 330 and the first and second cylindrical segments 340. Typically, the central tightening member 330 may be provided with external threads and the first and second cylindrical segments 340 may be provided with internal threads. In order to provide a beneficial tightening function, the central tightening member 330 advantageously has flat surfaces at its axial ends, as shown in FIG. 3.

Figure 4A:
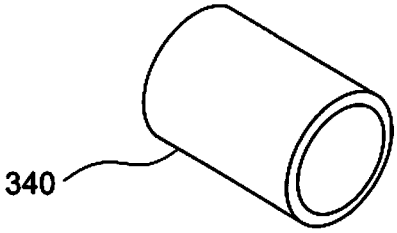
FIGS. 4A, B and C are various views illustrating a cylindrical segment.
Figure 4B:
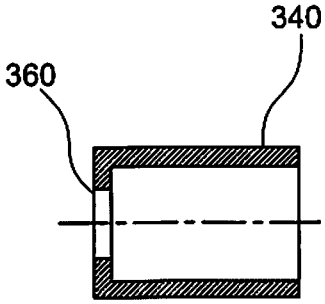
Figure 4C:
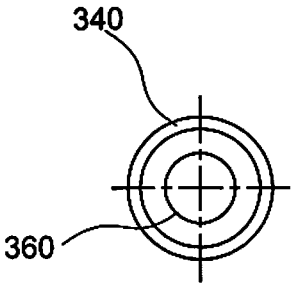

FIGS. 4A, B and C are various views illustrating a cylindrical segment 340. FIG. 4A is a perspective view of the cylindrical segment 340. FIG. 4B is a cross sectional view of the cylindrical segment 340. FIG. 4C is an end view of the cylindrical segment 340.

Figure 5A:
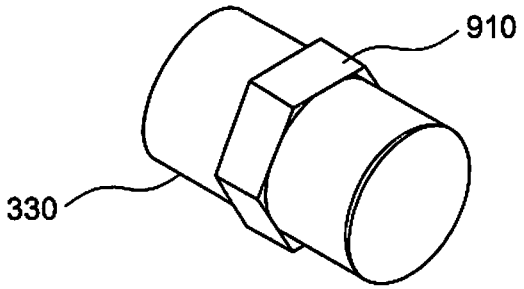
FIGS. 5A, B and C are various views illustrating a central tightening member.
Figure 5B:
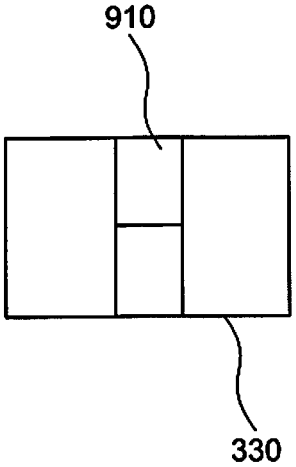
Figure 5C:
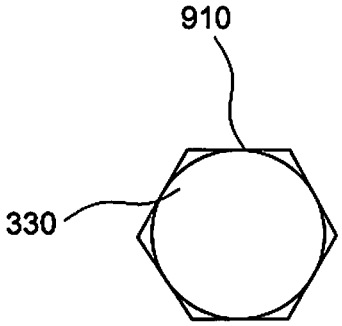

FIGS. 5A, B and C are various views illustrating a central tightening member 330. FIG. 5A is a perspective view of the central tightening member 330. FIG. 5B is a cross sectional view of the central tightening member 330. FIG. 5C is an end view of the central tightening member 330.

Figure 6A:
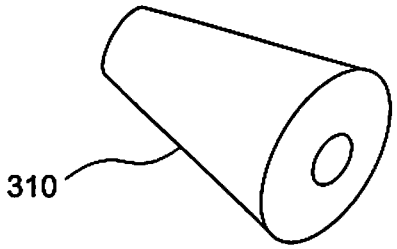
FIGS. 6A, B and C are various views illustrating an inner conical member.
Figure 6B:
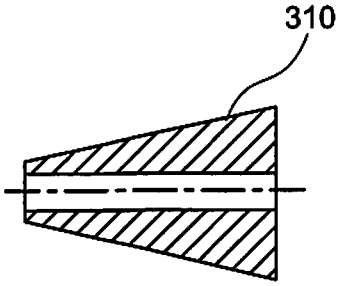
Figure 6C:
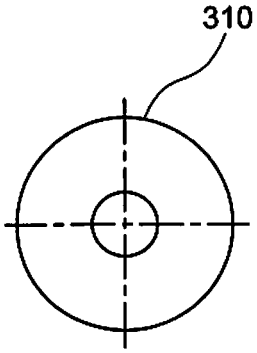

FIGS. 6A, B and C are various views illustrating an inner conical member 310. FIG. 6A is a perspective view of the inner conical member 310. FIG. 6B is a cross sectional view of the inner conical member 310. FIG. 6C is an end view of the inner conical member 310.

Figure 7A:
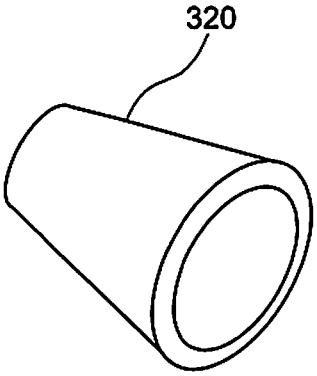
FIGS. 7A, B and C are various views illustrating an intermediate conical member.
Figure 7B:
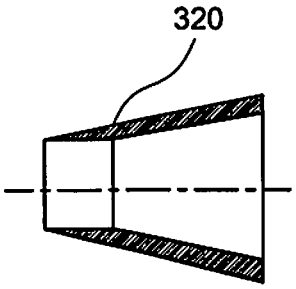
Figure 7C:
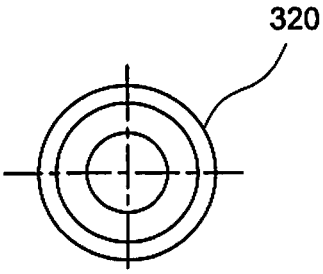

FIGS. 7A, B and C are various views illustrating an intermediate conical member 320. FIG. 7A is a perspective view of the intermediate conical member 320. FIG. 7B is a cross sectional view of the intermediate conical member 320. FIG. 7C is an end view of the intermediate conical member 320.

Figure 8A:
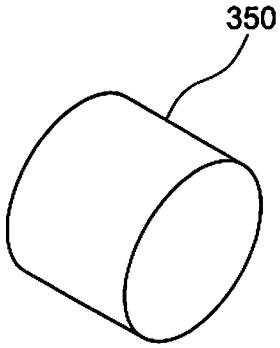
FIGS. 8A, B and C are various views illustrating an end piece.
Figure 8B:
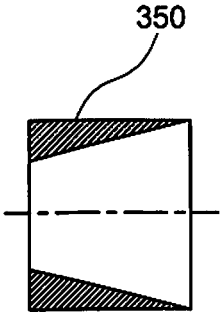
Figure 8C:
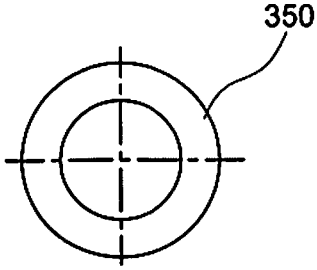

FIGS. 8A, B and C are various views illustrating an end piece 350. FIG. 8A is a perspective view of the end piece 350. FIG. 8B is a cross sectional view of the end piece 350. FIG. 8C is an end view of the end piece 350.

The device 200 and its components, i.e. the central tightening member 330, the first and second cylindrical segments 340, the inner conical member 310, the cylindrical end piece 350 and any further conical members such as the intermediate conical member 230, may be made of suitable materials according to use requirements, including hardness, tensile strength, etc. In many applications, various steel materials, e.g. stainless steel, may be applicable for the device 200 and its components.

Figure 9:
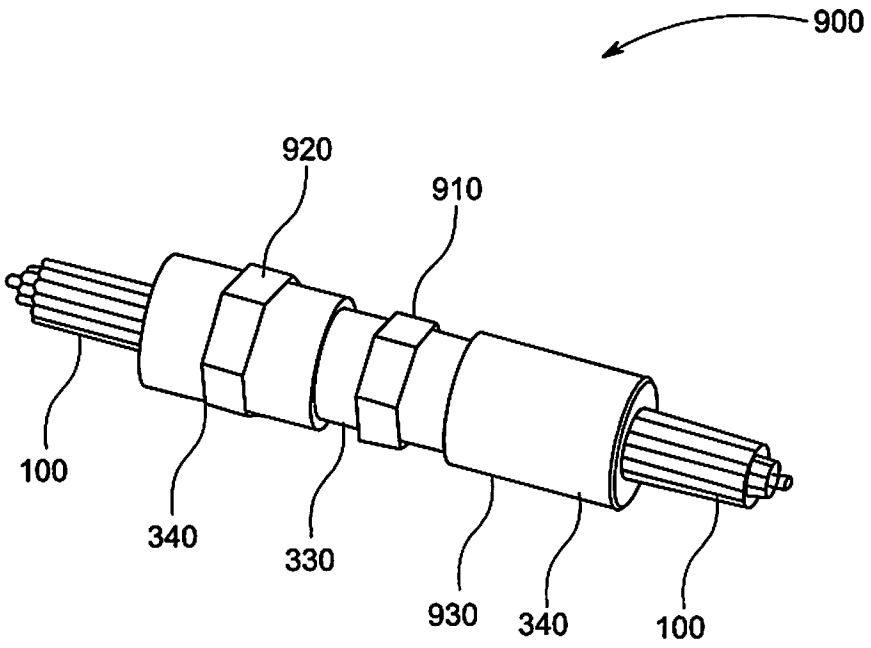
FIG. 9 is a perspective view illustrating various aspects of tightening and engagement means.

FIG. 9 is a perspective view illustrating various aspects of tightening and engagement means.

FIG. 9 illustrates an embodiment 900 of the device 200 which includes various engagement means 910, 920, 930. In order to facilitate the tightening function of the device 200, the central tightening member 330 and the first and second cylindrical segments may include engagement means for engagement with corresponding tightening tools. As shown in FIG. 9, the engagement means may for instance include collars 910, 920 provided on outer surfaces of the central tightening member 330 and the first and second cylindrical segments 340.

As shown in FIG. 9, the central tightening member 330 may have a hex collar 910 for engagement with a wrench or other external tightening device (not illustrated). In certain embodiments, one or both cylindrical segments 340 are required to have a smooth outer surface, for example where the cylindrical members are to be covered with a sheath or in other situations where the diameter of the cylindrical segments is of concern. In such situation a dedicated tightening tool may be employed to grip the smooth outer surface of the cylindrical segments 340 for tightening. In alternate embodiments, such as shown in FIG. 9, one or both of the cylindrical segments 340 may also be equipped with a hex collar 920 for engagement with a wrench or other external tightening device. Alternatively, other means for engaging an external tightening device may be provided, for example holes as illustrated at 930, arranged to receive pins from the external tightening device. The two cylindrical segments 340 may have different engagement means or identical engagement means, depending on use requirements.

The present specification also discloses a device 200 as described above, used to interconnect two cables. This results in a spliced cable, including two cables of the type having a core strand 110 and at least one layer of strands 120 coaxially surrounding the core strand 110 and a device as disclosed on the above specification for interconnecting the cables.

The invention claimed is:

1. A device for interconnecting cables of the type having a core strand and at least one layer of strands coaxially surrounding the core strand, the device comprising:

a solid central tightening member having entirely flat surfaces at its axial ends that span the entire width of said device;

first and second cylindrical segments, each cylindrical segment having an opening for insertion of an end of a cable at its distal end and being tightenably connected to the solid central tightening member at its central end;

an inner conical member arranged within each cylindrical segment, the inner conical member having a central bore arranged for insertion of an end of the core strand of the cable, the inner conical member further having an outer sloping surface on which a layer of strands coaxially surrounding the core strand of the cable may be positioned, the inner conical member further having a flat contact surface, opposite said outer sloping surface, said flat contact surface being the entire dimension of said inner conical member and for contacting said flat surfaces at said axial ends of said solid central tightening member;

a cylindrical end piece arranged within each cylindrical segment, the end piece having a central bore arranged for insertion of the cable, the end piece further having an inner sloping surface on which a layer of strands coaxially surrounding the core strand of the cable may be positioned;

wherein axial tightening of the solid central tightening member causes the inner conical member and the end piece to be axially pressed together with the layer of strands coaxially surrounding the core strand sandwiched between them, resulting in a stable interconnection of the cables' ends.

2. The device according to claim 1, wherein the solid central tightening member is provided with threads, and the first and second cylindrical segments are provided with corresponding threads that are mateable with the threads of the solid central tightening member, the axial tightening of the solid central tightening member being achieved by relative rotation between the solid central tightening member and the first and second cylindrical segments.

3. The device according to claim 2, wherein the solid central tightening member is provided with external threads and the first and second cylindrical segments are provided with internal threads.

4. The device according to claim 1, wherein an intermediate conical member is arranged within each cylindrical segment, the intermediate conical member having a central bore arranged for insertion of the core strand and an intermediate layer of surrounding strands of the cable, the intermediate conical member further having an inner sloping surface on which an intermediate layer of strands coaxially surrounding the core strand of the cable may be positioned, and an outer sloping surface on which an outermost layer of strands coaxially surrounding the core strand of the cable may be positioned.

5. The device according to claim 4, further comprising additional conical members arranged within each cylindrical segment, each additional conical member corresponding to an additional layer of surrounding strands of the cable.

6. The device according to claim 1, wherein the conical members have essentially the same slope on their outer surfaces.

7. The device according to claim 6, wherein the conical members have rear conical openings with an inner slope arranged to accept the forward conical portion of an adjacent conical member.

8. The device according to claim 1, wherein the solid central tightening member and the first and second cylindrical segments include engagement means for engagement with corresponding tightening tools.

9. The device according to claim 8, wherein the engagement means includes collars provided are faceted outer surfaces of the solid central tightening member and the first and second cylindrical segments.

10. A spliced cable, including two cables of the type having a core strand and at least one layer of strands coaxially surrounding the core strand, and a device as set forth in claim 1 for interconnecting the cables.

* * * * *